US005846137A

United States Patent [19]

Tremblay

[11] Patent Number: 5,846,137

[45] Date of Patent: Dec. 8, 1998

[54] VERTICALLY ADJUSTABLE FOLDABLE BRIDGE FOR A BILLIARD CUE

[75] Inventor: Robert L. Tremblay, Hot Springs Village, Ark.

[73] Assignee: George Adair, Livonia, Mich.

[21] Appl. No.: 912,421

[22] Filed: Aug. 18, 1997

Related U.S. Application Data

[60] Provisional application No. 60/024,389, Aug. 19, 1996.

[51] Int. Cl.[6] ..... A63D 15/00

[52] U.S. Cl. ..... 473/42

[58] Field of Search ..... 473/42

[56] References Cited

U.S. PATENT DOCUMENTS 2,014,788 9/1935 Strickler et al. ..... 473/42

2,817,525 12/1957 Niemann ..... 473/42

*Primary Examiner*—Theatrice Brown

*Attorney, Agent, or Firm*—James M. Deimen

[57] ABSTRACT

A new billiard cue bridge comprising a roughly H-shaped base which supports a generally upside down U-shaped vertical standard attached at the cross-bar of the base. The attachment is hinged at the cross-bar in a manner that permits the vertical standard to be latched in the vertical position and to fold down substantially flat with the base in the horizontal position. Mounted on the vertical standard are upper and lower slidable members. The upper slidable member includes a hole through which a pool or billiard cue may be passed and supported. Located in the upper portion of the hole is a small friction pad that permits the bridge to be lifted and repositioned by the cue. The lower slidable member functions as an optional positive lock to assure that the vertical standard remains in the latched vertical position when in use.

9 Claims, 1 Drawing Sheet

VERTICALLY ADJUSTABLE FOLDABLE BRIDGE FOR A BILLIARD CUE

BACKGROUND

This is a complete application based on provisional patent application Ser. No. 60/024,389, Aug. 19, 1996.

The field of the invention pertains to billiard and pool cues used for various games played on a billiard or pool table. In particular, the invention pertains to the "bridge" which is a device to support the cue near the tip for certain shots that otherwise would be very difficult to make properly.

The conventional bridge used to support a cue on a billiard table comprises a long handle substantially of the same shape as a cue. Rather than a tip, however, the bridge has a transverse wood plate with feet that can rest on the table and a plurality of smooth slots in the upper edge of the wood plate. The slots are shaped to retain and guide a cue when a shot is made.

The conventional bridge is about as long as a cue and noticeably more awkward and inconvenient to use especially when there is a crowd around the table.

SUMMARY OF THE INVENTION

The new bridge comprises a roughly H-shaped base which supports a generally upside down U-shaped vertical standard attached at the cross-bar of the base. The attachment is hinged at the cross-bar in a manner that permits the vertical standard to be latched in the vertical position and to fold down substantially flat with the base in the horizontal position.

Mounted on the vertical standard are upper and lower slidable members. The upper slidable member includes a hole through which a pool or billiard cue may be passed and supported. Located in the upper portion of the hole is a small friction pad that permits the bridge to be lifted and repositioned by the cue.

The lower slidable member functions as an optional positive lock to assure that the vertical standard remains in the latched vertical position when in use. While the new bridge can be sized as desired for convenience, it can be made small enough to slide into a man's shirt pocket when the vertical standard is folded down to the base. As such the new bridge is particularly convenient especially in comparison with a conventional bridge having a long handle approximately the length of a cue.

DESCRIPTION OF THE PREFERRED EMBODIMENT

Figure 1:
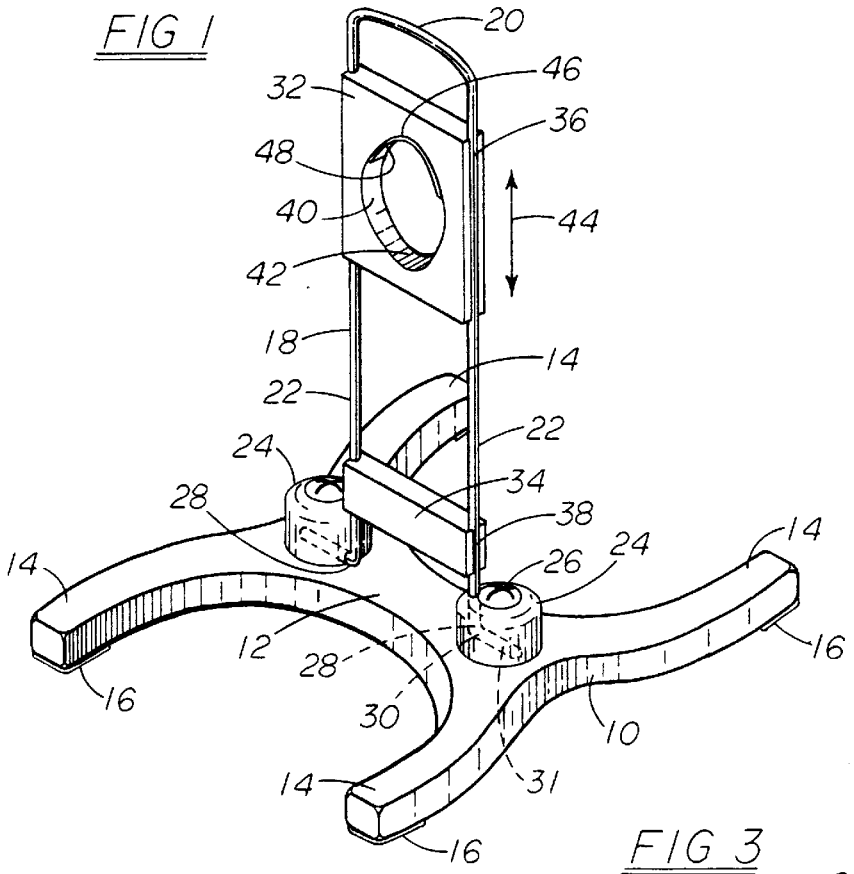
FIG. 1 is a perspective view of the new bridge.

In FIG. 1 the bridge comprises a generally H-shaped base 10 having a cross-bar 12 and four legs 14. Near the tip of each leg 14 is a rubber or felt pad 16 for non-slip and non-injurious contact with a pool or billiard table playing surface.

Figure 3:
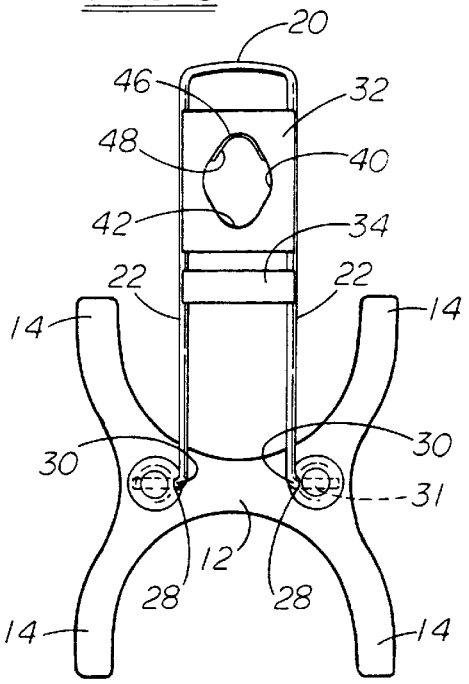
FIG. 3 is a plan view of the new bridge with the vertical standard folded down to the base.

Extending upwardly from the base 10 is a vertical standard 18 of metal rod formed into a U-shape with the base 20 of the U at the top and parallel vertical sides 22 extending downwardly to a pair of hinge means 24 in turn fastened by screws 26 to the base 10. Each of the hinge means 24 is formed with a vertical slot at 28 into which a vertical side 22 snaps to form a latch. As shown in FIGS. 1 and 3 the lower tip 30 of each side 22 is bent perpendicular thereto and fits into a small horizontal hole 31 formed in each hinge means 24 just above the cross-bar 12 of the base 10.

Returning to FIG. 1, extending between the sides 22 are upper 32 and lower 34 slidable members each formed with grooves 36 and 38 respectively in engagement with the sides 22. Each of the slidable members 32 and 34 engage the sides 22 with sufficient friction to prevent inadvertent relative motion on the sides 22 absent manual activation.

In FIG. 1 the lower member 34 is shown in locking position and in FIG. 3 the lower member is shown in raised position. In the raised position the lower member 34 permits the sides 22 to be manually sprung or squeezed inward enough to latch and unlatch the sides from the slots at 28. Conversely in the lower most position shown in FIG. 1 the lower member 34 prevents the sides 22 from being sprung from the slots at 28 and thereby prevents the vertical standard 18 from inadvertently being folded down to the base 10. Although one form of lockable latched hinge means 24 is described here other means to perform the same function may be envisioned.

The upper slidable member 32 includes a vertically oblong hole 40 therethrough. The lower portion 42 of the hole 40 is sized to accept a cue and support the cue for a shot by a player. The vertical height of the bridge may be manually adjusted by the player by sliding the upper member 32 on the sides 22 as indicated by arrow 44. The lower portion 42 of the hole 40 is smooth so as to not interfere with the smooth movement of the cue by the player in making a shot.

Figure 2:
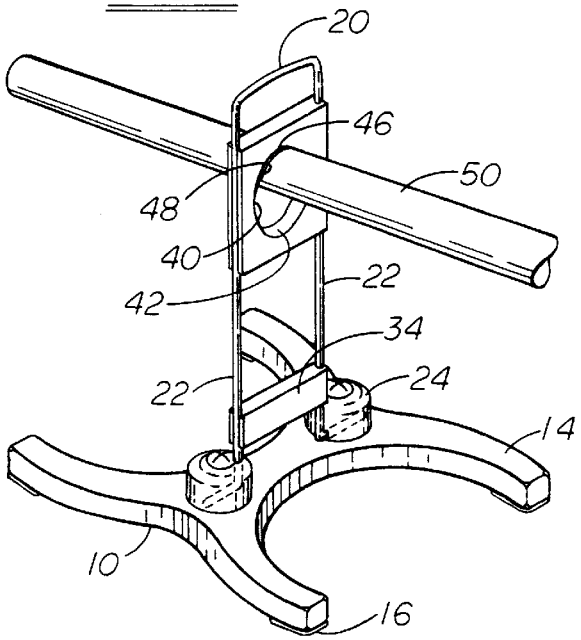
FIG. 2 is a perspective view of the new bridge with a portion of a cue inserted in lifting position.

In contrast to the smooth lower portion 42 of the hole 40 is the upper portion 46 of the hole 40 which is either equipped with the friction pad 48 as shown in FIGS. 1 and 3 or otherwise roughened. As best shown in FIG. 2 a cue 50 applied to the upper portion 46 and pad 48 of the hole 40 may be used to conveniently lift the bridge and move the bridge to another location on the table. Thus, the bridge can be remotely repositioned as desired by the player with his cue. The friction pad 48 prevents the bridge from inadvertently sliding off the tip of the smooth polished cue.

I claim:

1. A cue bridge comprising a base, a vertical standard hingedly mounted on the base, an upper member selectably slidable on the vertical standard, said upper member having a hole therethrough for accepting and supporting a cue placed therethrough, and said hinged mounting including means to latch the vertical standard in the upright position on the base.

2. The cue bridge of claim 1 including separate locking means to prevent inadvertent delatching of the vertical standard from the upright position.

3. The cue bridge of claim 1 including friction means on the upper portion of the hole adapted to frictionally engage a cue for support of the bridge on the cue.

4. The cue bridge of claim 3 wherein the hole is generally oblong with the major axis of the hole oriented vertically.

5. The cue bridge of claim 1 wherein the hole is generally oblong with the major axis of the hole oriented vertically.

6. The cue bridge of claim 1 including separate locking means to prevent inadvertent delatching of the vertical standard from the upright position, said locking means selectably slidable on the vertical standard.

7. The cue bridge of claim 1 wherein the vertical standard is rotatable about the hinged mount to about 90° from the upright position.

8. The cue bridge of claim 1 wherein the base is generally H-shaped in plan view, the hinged mount being located at the cross-bar of the H.

9. A cue bridge comprising a base, a vertical standard hingedly mounted on the base, an upper member and a lower member each selectably slidable on the vertical standard, said upper member having an oblong hole therethrough for accepting and supporting a cue placed therethrough, said hinged mounting including means to latch the vertical standard in the upright position on the base, said lower member comprising separate locking means to prevent inadvertent delatching of the vertical standard from the upright position, and friction means on the upper portion of the oblong hole adapted to frictionally engage a cue for support of the bridge on the cue.

* * * * *